US005839154A

United States Patent [19]

Kawai et al.

[11] Patent Number: 5,839,154

[45] Date of Patent: Nov. 24, 1998

[54] CHEWING GUM REMOVER

[75] Inventors: Yuzo Kawai; Katsutoshi Naramura; Yoshihide Takahashi, all of Nara-ken, Japan

[73] Assignee: Suiden Co., Ltd., Japan

[21] Appl. No.: 563,495

[22] Filed: Nov. 28, 1995

[51] Int. Cl.[6] ..... A47L 5/30

[52] U.S. Cl. ..... 15/320; 15/93.1; 15/380; 15/401

[58] Field of Search ..... 15/380, 401, 93.1, 15/320

[56] References Cited

U.S. PATENT DOCUMENTS

| | | | |
|---|---|---|---|
| 2,232,367 | 2/1941 | Cherry | 30/272 |
| 2,481,760 | 9/1949 | Leher | 219/39 |
| 3,733,637 | 5/1973 | Becker | 15/93 |
| 4,559,661 | 12/1985 | Tsals et al. | 15/93 |
| 4,821,357 | 4/1989 | Millette | 15/93 |
| 4,947,515 | 8/1990 | Ivarsson | 15/401 |
| 5,287,582 | 2/1994 | Kawai et al. | 15/93.1 |
| 5,341,541 | 8/1994 | Sham | 15/320 |

FOREIGN PATENT DOCUMENTS

| | | | |
|---|---|---|---|
| 3502083 | 8/1986 | Germany | 15/380 |
| 128338 | 5/1950 | Sweden | 15/380 |

*Primary Examiner*—Chris K. Moore
*Attorney, Agent, or Firm*—Morrison Law Firm

[57] ABSTRACT

A device for removing an adhered foreign substance, such as chewing gum, from surfaces employs a reciprocating scraper that separates the substance from the surface to be cleaned. A liquid, such as cleaning solution or solvent, is optionally discharged in the vicinity of the end of the scraper to augment the separation. A vacuum device draws air and loosened matter into an opening in the nozzle and traps it in a container. Optionally, the vacuum device is attached to a nozzle movable away from and toward the scraper by pushing a handle. When the nozzle moves toward the scraper, it activates the vacuum device.

13 Claims, 13 Drawing Sheets

CHEWING GUM REMOVER

BACKGROUND OF THE INVENTION

The present invention relates to vacuum cleaners. More specifically vacuum cleaners with scraping devices. Particularly, vacuum cleaners with reciprocating scrapers capable of dislodging and picking up foreign matter that is adhered to surfaces.

Vacuum cleaning devices are known that simultaneously supply a vacuum air flow and a cleaning solution, or steam, to an area to be cleaned. It is also known to attach a vacuum cleaning device to a scraper blade in order to carry away scraped-off particles. Additionally, reciprocating scrapers powered by air or electric motors are known for use in the removal of paint and foreign substances from surfaces.

With the proliferation of non-smoking areas, particularly in railroad station buildings and yards, chewing gum has increased as a substitute for smoking. Attending this increased use of chewing gum is an increased need to remove, and dispose of, chewing gum left on floors and sidewalks. Such chewing gum adheres tenaciously and is difficult to remove. Cleaning personnel frequently resort to using scrapers or other hand tools to remove gum from these surfaces. Such methods are slow and burdensome. In addition, because such methods expose cleaning personnel to used chewing gum, they are also unsanitary.

For these reasons, an instrument that allows rapid removal of chewing gum from the floor is desirable. Additionally, an instrument that minimizes the exposure of workers to unsanitary used chewing gum is also desirable.

Additionally, many industries utilize adhesives to bond coverings to surfaces. Examples include stuccos, wallpapers, tiles, etc.. Coatings such as paints can also be classified similarly because the adhesive nature of the coating is inherent in the coating itself. Eventually, coverings and coatings become worn and need to be replaced. However, a prerequisite for proper replacement is removal of the old covering or coating.

Like chewing gum, removal of old coatings and coverings often presents difficulties because the adhesives cling tenaciously to the surface. Often the removal method includes scraping. In these instances, the coating or covering comes off in small pieces making removal tedious, tiring and time consuming. Additionally, the adhesives involved sometimes remain partially active and the small pieces can re-adhere. This obscures the work area inhibiting progress and causing workers to "miss a spot".

Like chewing gum, removal of old coatings and coverings can be augmented by application of cleaning solutions or solvents. However, the solvents themselves cause the small pieces that are loosened to aggregate on the work surface. Again, the presence of the many already-removed particles obscures the work area and interferes with the detection of not-yet-loosened substance.

Additionally, the solutions are often not effective because they are applied to the outer surface of the substance to be removed. As such, the solvent or solution cannot easily penetrate to the interface where the adhesive contacts the surface to be cleaned.

In view of these problems it would be advantageous to have a scraping device for dislodging adhered materials that can also effectively remove old coatings and coverings from a work area as they are dislodged. Moreover, it would also be advantageous to have such a device apply a solvent or cleaning solution directly to the interface where the scraping device is contacting the substance that is being removed.

OBJECTS AND SUMMARY OF THE INVENTION

It is an object of the present invention to provide a device that rapidly removes foreign matter such as waste chewing gum from a surface such as a floor.

It is a further object of the present invention to provide a device that makes less difficult the task of removing such foreign matter adhering to a surface such as a floor.

It is a further object of the present invention to make more sanitary the task of removing potentially contaminated foreign matter that is adhering to a surface such as a floor.

It is a still further object of the invention to provide an instrument, for the removal of adhered foreign matter from surfaces, that thoroughly cleans areas from which foreign matter has been removed.

It is a still further object of the invention to provide an instrument, for the removal of adhered foreign matter from surfaces, that is highly effective and portable.

It is a still further object to provide a device that prevents the accumulation of already-removed foreign matter on the surface where foreign matter removal is in progress.

It is a still further object of the present invention to provide an instrument for the removal of adhered foreign matter from a surface that can deliver a liquid such as cleaning solution or solvent to the interface of the surface and the adhered foreign matter.

It is a further object of the present invention to overcome the deficiencies of the prior art devices.

Briefly stated, the present invention provides a device for removing an adhered foreign substance such as chewing gum from surfaces. The device employs a reciprocating scraper or blade that separates the substance from the surface to be cleaned. A liquid such as cleaning solution or solvent is optionally discharged in the vicinity of the end of the scraper to augment the separation. A nozzle is movable away from and toward the scraper by pushing a handle. When the nozzle moves toward the scraper, it activates a vacuum device. The vacuum device draws air and loosened matter into an opening in the nozzle and traps it in a container.

According to an embodiment of the present invention there is disclosed a device for removing adhered material from surfaces, comprising: a frame, a scraper extending from the frame, means in the frame for reciprocating the scraper with respect to the frame, the scraper having an outer end shaped for removal of adhered material from a surface, a container, and means for moving pieces of material loosened by the scraper into the container.

According to another embodiment of the present invention there is disclosed a device for removing adhered material from surfaces, comprising: a frame, a reciprocating scraper having a knife edge, the reciprocating scraper mounted on the frame, vacuum cleaner means oriented for drawing a suction air flow over the knife edge, and means for delivering a liquid to the knife edge.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
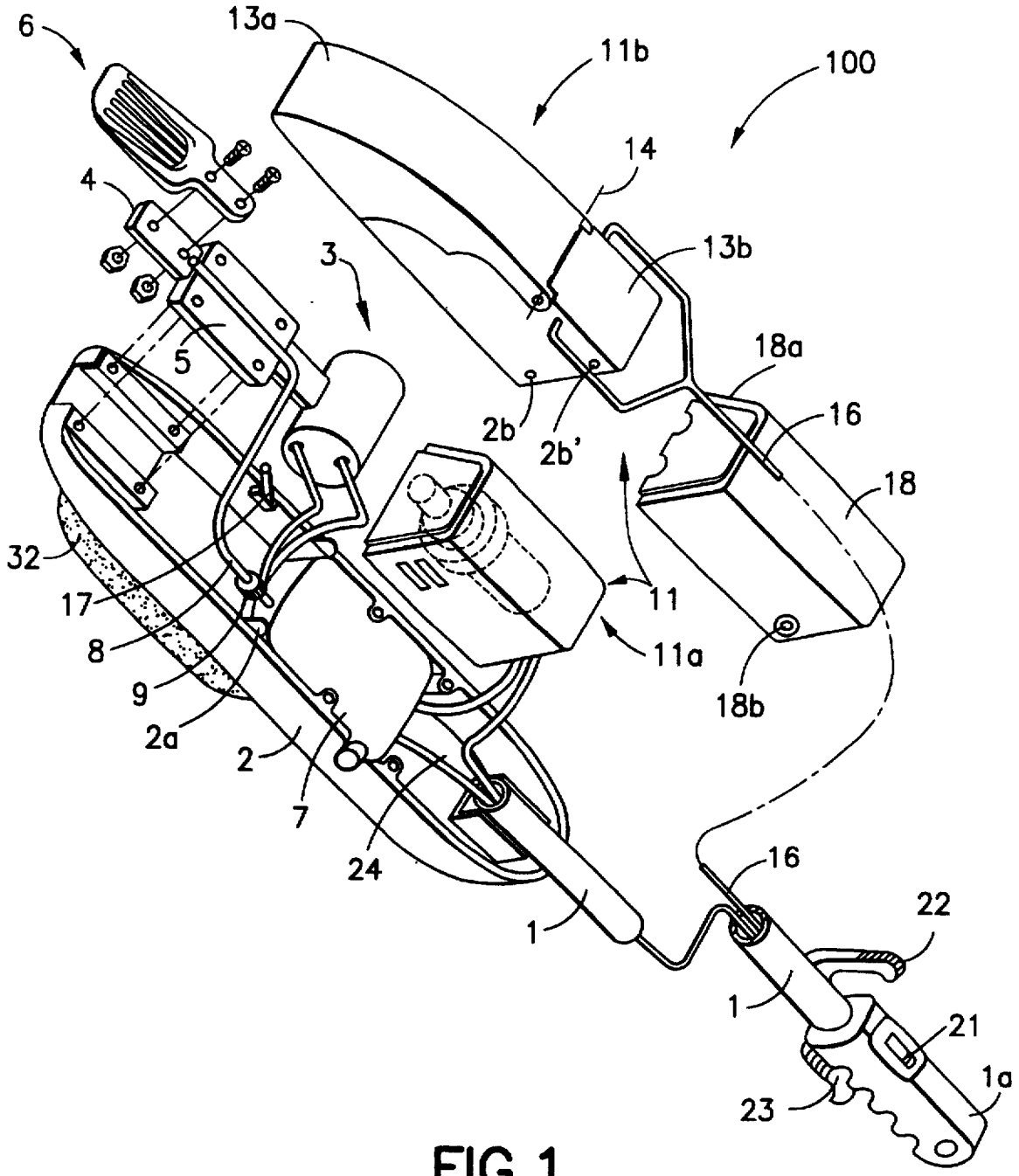
FIG. 1 is an exploded view of a chewing gum remover according to an embodiment of the present invention.

Referring to FIG. 1, a chewing gum remover 100 has a boat shaped casing 2 attached to a first end of a hollow shaft 1. A handle 1*a* is attached to a second end of hollow shaft 1. Boat-shaped boat shaped casing 2 contains a reciprocating driver 3. A reciprocating support 4, attached to reciprocating driver 3 transfers reciprocating motion through a guide member 5 to a reciprocating scraper blade 6 attached thereto. Guide member 5 is fixed within the end of boat shaped casing 2 opposite the attachment to hollow shaft 1. Guide member 5 guides reciprocating support 4 and regulates the range and direction of the reciprocating motion imparted there-through from reciprocating driver 3.

A tank 7, removably attached within boat shaped casing 2, provides fluid to reciprocating scraper blade 6 through a tubing 8. The passage of fluid through tubing 8 is regulated by valve 9. Valve 9, near the junction of tubing 8 and tank 7, is opened and closed whenever a valve lever 23 on handle 1*a* is actuated and released by the operator.

A vacuum cleaner system 11 is attached to the top of boat shaped casing 2 in such alignment that a suction nozzle 13*a* is aligned with the blade end of reciprocating scraper blade 6. Vacuum cleaner system 11 has a collector section 11*b* consisting of a suction nozzle 13*a* pivotably attached at a hinge axis 14 to a collection chamber 13*b*. Collection chamber 13*b* communicates through filtered openings with a suction fan section 11*a*. Suction fan section 11*a* houses a motorized fan that draws air rapidly, along with debris, from the area around reciprocating scraper blade 6 through suction nozzle 13*a* into collection chamber 13*b*. Debris, collected in collection chamber 13*b*, is accessed and removed by rotating suction nozzle 13*a* around hinge axis 14 and away from collection chamber 13*b*.

Power to operate reciprocating driver 3 and the motorized fan in suction fan section 11*a* is provided by batteries housed in battery pack housing 18. Optionally, power is supplied through an external power receptacle 18*b*. A power switch 21 on handle 1*a* controls the power collectively coming from battery pack housing 18 and external power receptacle 18*b*. When power switch 21 is on, power is received by reciprocating driver 3 and the motorized fan in suction fan section 11*a*.

Optionally, for additional control, a limit switch 17, mounted on boat shaped casing 2 below collector section 11*b*, can be actuated by a nozzle lever 22. Moving nozzle lever 22 causes a bifurcated rod 16 to rotate collector section 11*b* forward around lugs 2*a* at a rotation attachment point 2*b*. This forward rotation simultaneously moves suction nozzle 13*a* closer to reciprocating scraper blade 6 causing a bottom edge of collection chamber 13*b* to contact and actuate limit switch 17.

Alternatively, lugs 2*a* may be longer and attached to a rotation attachment point 2*b*'. This allows collector section 11*b* of vacuum cleaner system 11 to be rotated backward for better viewing of the operation of scraper 6, and forward for activating limit switch 17. The two attachment points 2*b* and 2*b*' are alternative embodiments, where in the former, collector section 11*b* swings downwardly (toward scraper 6) and in the latter, collector section 11*b* swings upwardly (away from scraper 6).

The preferred configuration is for attachment points 2*b*' to be located at the top of collector section 11*b* and suction section 11*a*. This provides adequate clearance and allows the operator to see better what is being scraped because the nozzle is lifted far away from scraper 6. In the embodiment where attachment point 2*b* is used, sufficient clearance between suction fan section 11*a* and collector section 11*b* must be provided such that collector section 11*b* does not bump into suction fan section 11*a*. In this embodiment, when traction wire 16 is pulled, collector section is lifted up and far away from scraper 6. In the embodiment where attachment point 2*b*' is used, scraper 6 may be more optimally located further downward from the position shown in FIG. 3 to provide sufficient clearance for large pieces of gum to be admitted under the nozzle. In any embodiment, the limit switch 17 must be located to start the vacuum only when the nozzle is in position to actually suck the gum.

A seal (not shown) can be provided, in either embodiment, to prevent any leakage between suction fan section 11*a* and collector section 11*b*. Such a seal could take the form of a flexible rubber boot, semi-flexible leaves on each of suction fan section 11*a* and collector section 11*b* positioned to lap each other, or any other conventional sealing device.

Also note that another variation on the configuration of the invention (best seen in FIG. 3) is to connect the traction wire to nozzle 13*a*. During operation, only nozzle 13*a* is lifted to clear the view of reciprocating scraper 6.

A sponge 32 is optionally attached to boat shaped casing 2 at a bottom forward position.

Figure 2:
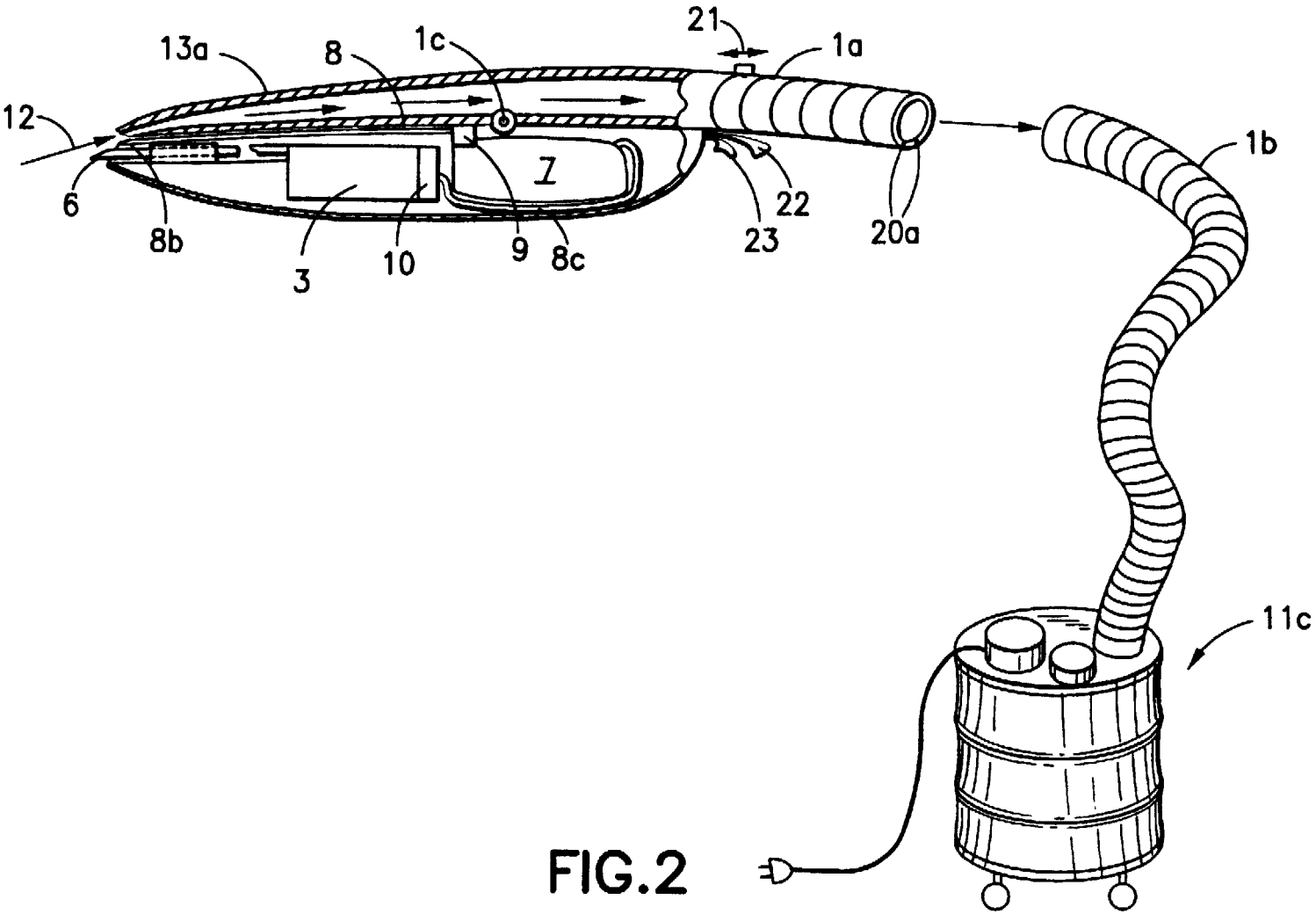
FIG. 2 is a longitudinal cross section of a second embodiment of the present invention. forward portion of the chewing gum remover of FIG. 1 showing the relative positions of a gum container and a suction device.

Referring to FIG. 2, a second embodiment of the present invention includes an external vacuum 11*c*, such as a canister type vacuum, connected by a flexible hose 1*b* to hollow shaft 1 at handle 1*a*. Hollow shaft 1 is in turn connected directly to suction nozzle 13*a*. An air flow 12 crosses reciprocating blade 6, picking up and carrying loosened particles through suction nozzle 13*a*, down flexible hose 1*b* and into external vacuum 11*c*.

Power is supplied from canister type external vacuum 11*c* through external power supply wires 20*a* embedded in the wall of flexible hose 1*b* and handle 1*a*. Boat shaped casing 2, which houses the reciprocating scraper system and the fluid supply system is attached to the bottom of suction nozzle 13*a*. A side handle 1*c*, optionally provided, is attachable to either side for user convenience.

Reciprocating driver 3 not only provides reciprocating movement to reciprocating scraper blade 6 as in the first embodiment but also powers an air pump 9*c*. Air pump 9*c*, pumping air through a pressure tubing 8*c*, pressurizes tank 7 such that when a valve 9 is opened by valve lever 23, fluid fills tubing 8 and exits under pressure from a liquid nozzle 8*b*. Liquid nozzle 8*b* is directed to spray or drop exiting liquid sprays directly onto the knife edge of reciprocating scraper blade 6.

Figure 3:
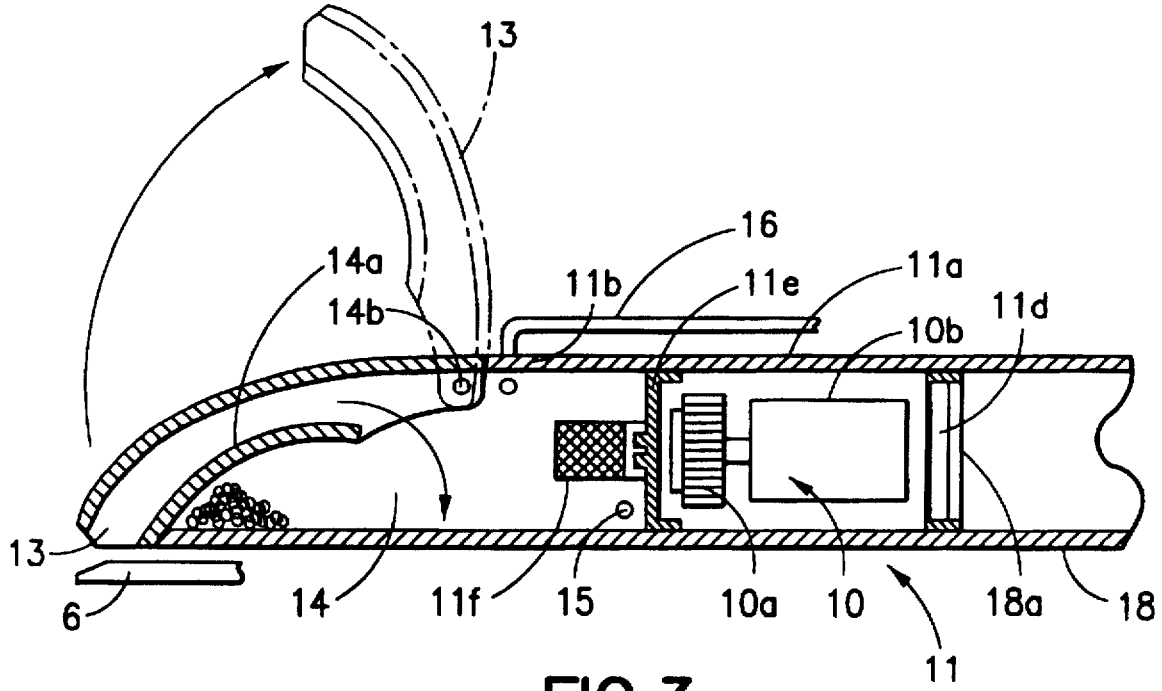
FIG. 3 is a longitudinal cross section of the forward portion of the chewing gum remover of FIG. 1 showing the relative positions of a gum container and a suction device.

Referring now to FIG. 3 in the context of FIG. 1, a vacuum cleaner system 11, fixed to boat shaped casing 2 atop tank 7, includes suction fan section 11*a* which houses a suction device 10, and collector section 11*b*. Suction device 10 includes a fan 10*a* driven by a fan motor 10*b*. One end of suction fan section 11*a* has a filter plate 11*e* with perforated ribs through which air passes. A filter 11*f* entirely covers the perforated ribs of filter plate 11*e*. The other end of suction fan section 11*a* is a rear opening 11*d* that fits over a shoulder of a front portion 18*a* of battery pack housing 18.

A swingably detachable suction nozzle 13*a* is connected to collector section 11*b*. The main cavity of collector section 11*b* is a collection chamber 13*b*. A partition wall 14*a*, a component of suction nozzle 13*a*, partitions collection chamber 13*b* from suction nozzle 13*a*. When suction nozzle 13*a* is closed (solid line position), partition wall 14*a* rises from a bottom of collection chamber 13*b* and bends toward filter 11*f* to form an air communication passage with the upper surface of suction nozzle 13*a*. For emptying collection chamber 13*b*, suction nozzle 13*a* with partition wall 14*a*, swings to an open (dashed line) position by pivoting about a hinge pin 14*b*.

A rear opening of collection chamber 13*b* fits over a shoulder portion of suction fan section 11*a*. Studs 15, protruding from lugs 2*a* on boat shaped casing 2, pivotably engage holes at the bottom end of the side walls of collection chamber 13*b*. A bifurcated end of a bifurcated rod 16 is anchored to collection chamber 13*b*. A non-bifurcated end of bifurcated rod 16 is attached to nozzle lever 22 mounted on hollow shaft 1 near a handle 1*a*. When nozzle lever 22 is actuated, bifurcated rod 16 pivots collection chamber 13*b*, and suction nozzle 13*a*, downwardly forward about studs 15.

Figure 4:
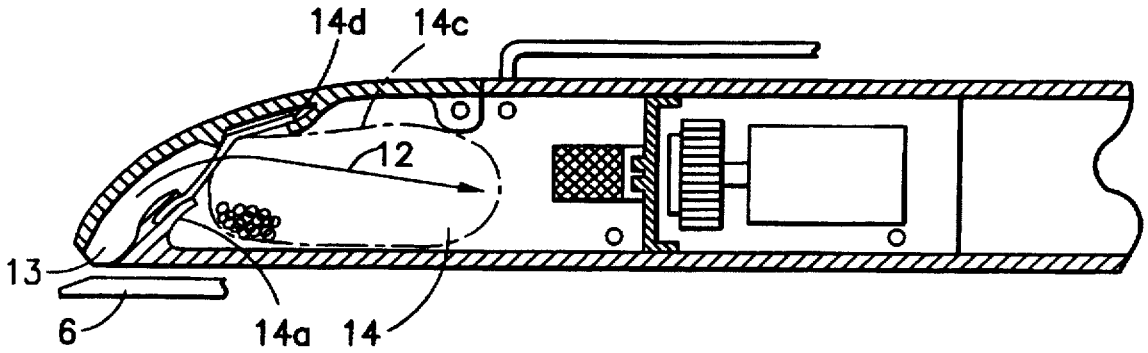
FIG. 4 is a longitudinal cross section of the forward portion of the chewing gum remover of FIG. 1 showing the use of a removable collection bag.

Referring now to FIG. 4, a disposable mesh bag 14*c* is in place in collection chamber 13*b*. In this embodiment, partition wall 14*a* is shortened and a rigid bag attachment 14*d* portion of disposable mesh bag 14*c* is tightly fitted in the path of air flow 12. Particles carried on air flow 12 are retained within disposable mesh bag 14*c* as air flow 12 passes through. As in the embodiment of FIG. 3, access is gained to collection chamber 13*b* by swinging suction nozzle 13*a* to its open position.

Figure 5:
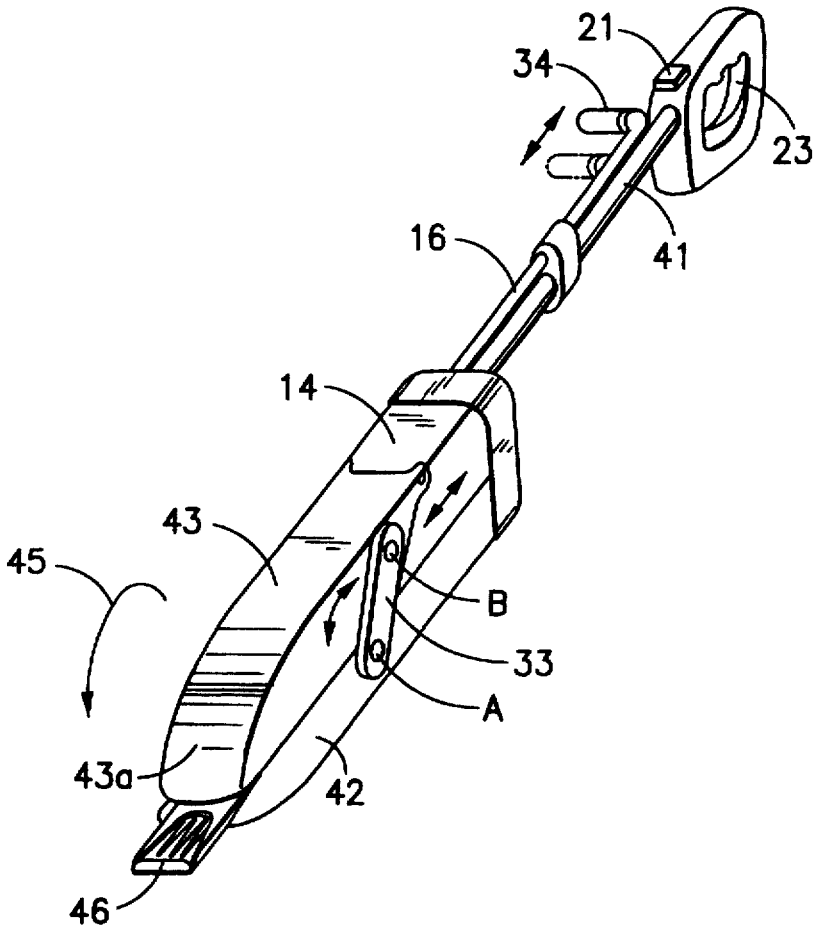
FIG. 5 is a perspective view of a chewing gum remover according to a further embodiment of the present invention.

Referring now to FIG. 5, which in the context of FIG. 1 shows an alternative embodiment of the present invention that gives a better visual clearance during operation of the reciprocating scraper. This embodiment has an arm 33 having a first end pivotably connected to a casing stud A on a side surface of a casing 42. A second end of arm 33 is connected pivotably to a nozzle stud B on a side surface of a nozzle member 43. Nozzle member 43 and a gum container 44 are substantially identical to suction nozzle 13*a* and collection chamber 13*b* of FIG. 1. Gum container 44 is slidably coupled to casing 42. A hollow shaft 41 has a nozzle compartment lever 34 connected to gum container 44.

Pushing forward on nozzle compartment lever 34 slides gum container 44 in the direction of nozzle member 43. This swings arm 33 and moves the forward portion 43*a* of nozzle member 43 in an arcuate path 45, first away from casing 42, then toward a reciprocating scraper 46, then down over reciprocating scraper 46. Pulling backward on nozzle compartment lever 34 reverses this motion. Arcuate path 45 indicates the forward and reverse motions of forward portion 43*a* of nozzle member 43. The arcuate motion of forward portion 43*a* of nozzle member 43 prevents forward portion 43*a* from pushing gum off reciprocating scraper 46.

During operation of reciprocating scraper 46, nozzle member 43 is in a withdrawn position as shown in FIG. 5. When material is loosened from a surface by reciprocating scraper 46, the operator can move nozzle compartment lever 34 forward to cause nozzle member 43 to move into place over the loosened material and remove it to gum container 44. The shape of gum container 44 is identical to that of collection chamber 13*b*, described above. Thus gum container 44 holds gum securely during movement of nozzle member 43.

Figure 6:
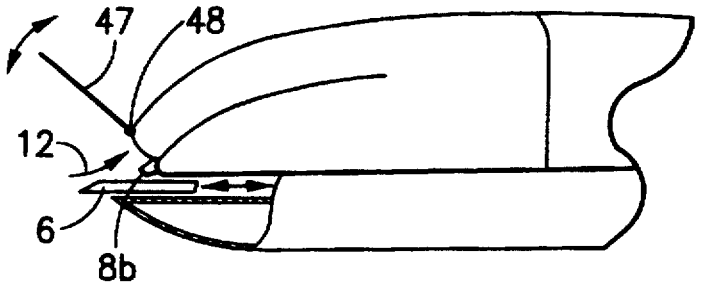
FIG. 6 is a longitudinal cross section of the front-most portion of a chewing gum remover of the present invention showing the attachment of an optional safety shield.

Referring now to FIG. 6, the embodiments of FIGS. 1 and 2 are adapted with an optional shield 47. Shield 47, made of a transparent material, allows visual observation of the knife edge of reciprocating scraper blade 6 and augments air flow 12 across reciprocating scraper blade 6 while protecting the worker from flying materials that may be generated by reciprocating scraper blade 6. Additionally, aerosolization of liquid from liquid nozzle 8*b* by the reciprocating action of reciprocating scraper blade 6 is directed away from the worker. The position of shield 47 can be optimized by tilting forward or backward around a hinge point 48.

Figure 7:
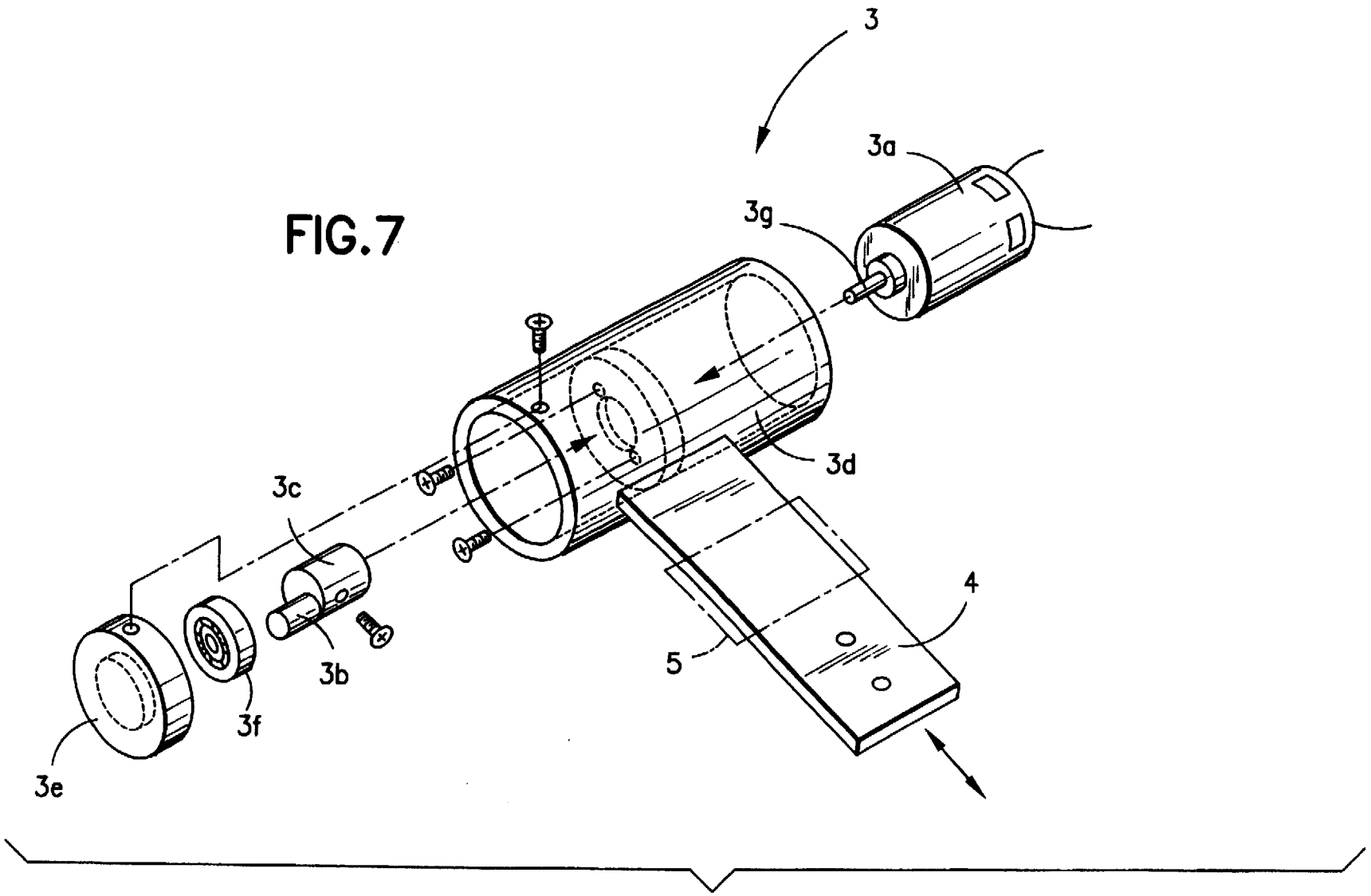
FIG. 7 is an exploded view of a reciprocating driver mechanism attached to a reciprocating support.

Referring now to FIG. 7, reciprocating driver 3 has a motor 3*a* with a driving shaft 3*g*. A coupler 3*c* is connected to driving shaft 3*g*. Coupler 3*c* includes an idling shaft 3*b*. One end of a driver casing 3*d* includes an opening. A bearing support ring 3*e* is fitted into the opening. Bearing support ring 3*e* holds a bearing 3*f* for supporting idling shaft 3*b*. Reciprocating support 4 is attached to driver casing 3*d*. A reciprocating scraper blade 6 is detachably coupled to reciprocating support 4 by suitable means, such as bolts and nuts. When motor 3a runs, coupler 3c rotates eccentrically about shafts 3b and 3g inertially oscillating reciprocating driver 3. The oscillation of reciprocating driver 3 is transferred through reciprocating support 4 to reciprocating scraper blade 6.

Figure 8:
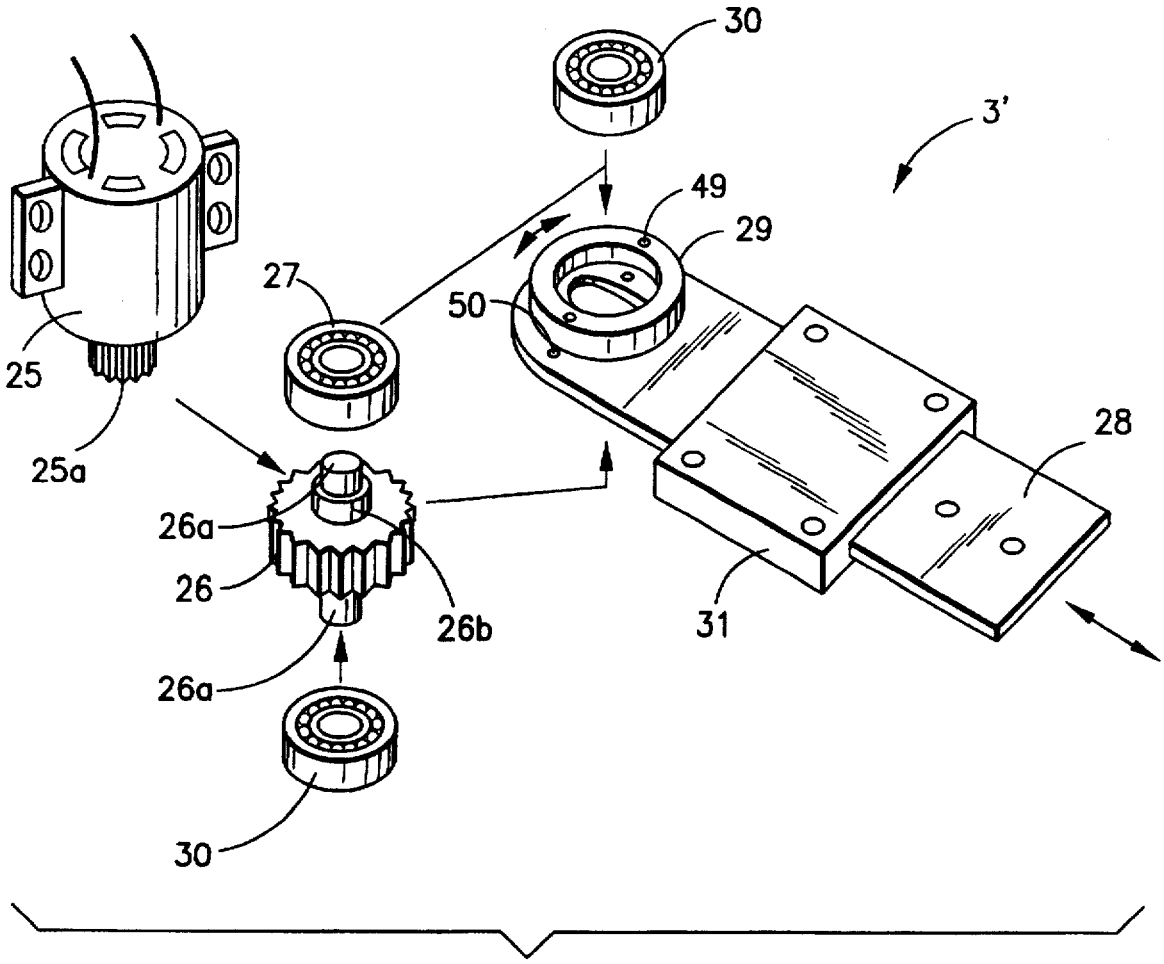
FIG. 8 is an exploded view of another reciprocating driver mechanism interacting with a reciprocating support.

Referring now to FIG. 8, an alternative design of a reciprocating driver 3' employs an electric motor 25 and a driving gear 25a engaged with a coupling gear 26. Coupling gear 26 has two main shafts 26a whose axes are identical to that of coupling gear 26. Coupling gear 26 also has an eccentric shaft 26b whose axis is a specified distance from that of coupling gear 26. A bearing 27, rotatably connects eccentric shaft 26b within a support ring 29. Support ring 29 is slidably connected to one end of a reciprocating support 28 by laterally sliding pins 49. Laterally sliding pins 49, immobilized in support ring 29, are slidably captured in lateral slots 50 of reciprocating support 28. Bearings 30 support both main shafts 26a in casing mounts (not shown). A guide member 31 holds reciprocating support 28 so that reciprocating support 28 is free to reciprocate over a narrow range.

When electric motor 25 runs, coupling gear 26 is rotated by driving gear 25a. Eccentric shaft 26b moves bearing 27 in a circular path about the axis of coupling gear 26. Support ring 29 on reciprocating support 28 is thereby made to move in the same circular path having lateral and sagittal components. Support ring 29 reciprocates laterally, with respect to reciprocating support 28, in lateral slots 50 without effecting reciprocating support 28. The sagittally directed reciprocating component of the support ring 29 circular motion, however, is transferred through reciprocating support 28 to reciprocating scraper blade 6 mounted at the other end.

Figure 9A:
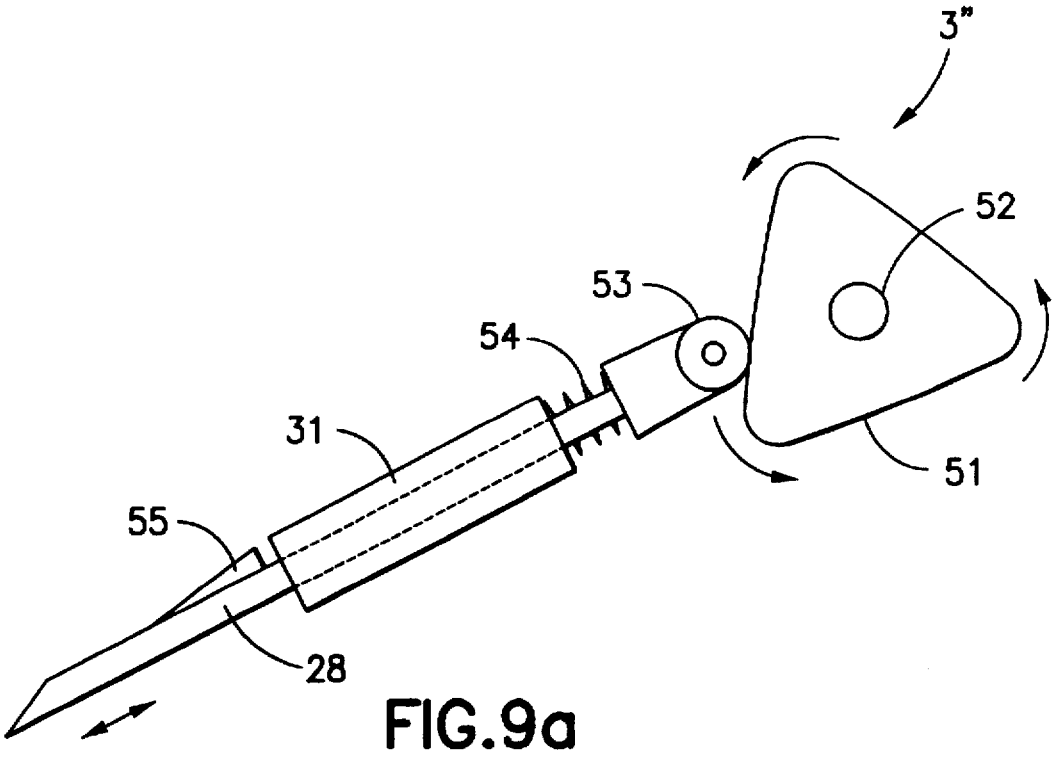
FIG. 9*a* is a side view illustration of yet another reciprocating driver mechanism interacting with a reciprocating support.
Figure 9B:
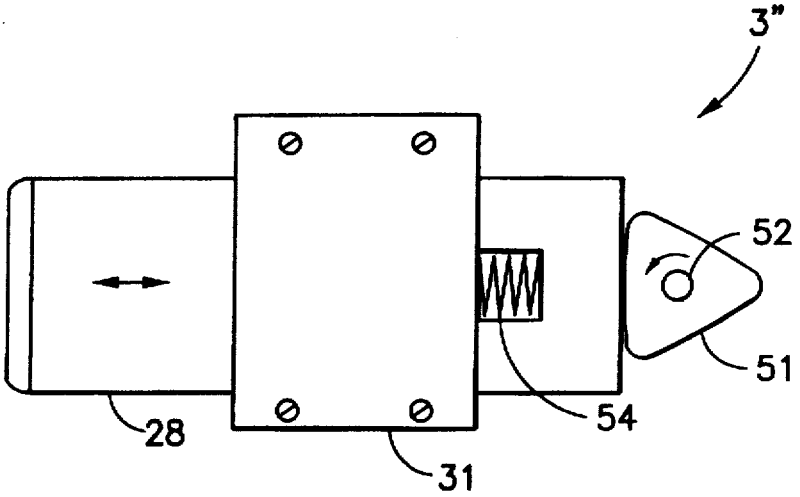
FIG. 9*b* is a top view illustration of still another reciprocating driver mechanism interacting with a reciprocating support.

Referring now to FIGS. 9a and 9b, another alternative design of a reciprocating driver 3" employs a multilobed cam 51 rotating on a drive shaft 52 against an end of reciprocating support 28. A spring 54 maintains constant contact of the end of reciprocating support 28 with multilobed cam 51. Stops 55 may optionally be disposed to prevent jamming and for ease of assembly.

Specifically, FIG. 9a is an example where multilobed cam 51 is deployed to rotate transversely across the end of reciprocating support 28. Optionally, multilobed cam 51 is contacting a roller bearing 53 rotationally disposed laterally on the end of reciprocating support 28. Alternatively, FIG. 9b is an example where multilobed cam 51 is deployed to rotate laterally across the end of reciprocating support 28.

Figure 10A:
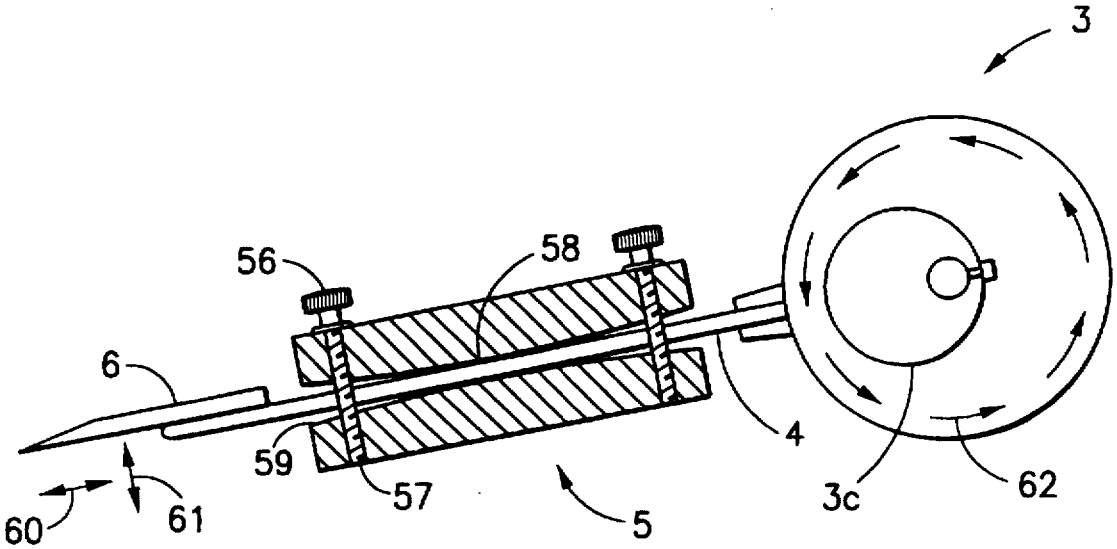
FIG. 10*a* is an illustrative cross section of a first example of guide member function effecting the motion of a reciprocating support.

Referring now to FIG. 10 in the context of FIG. 7, a cross section of reciprocating driver 3 of the first example illustrates the principal whereby a rotational movement 62 of coupler 3c translates into the reciprocating motion of reciprocating scraper blade 6. In FIG. 10a, guide member 5 contacts reciprocating support 4 at a contact point 58 on a curved inner surface 59. The location of contact point 58 and the amount of frictional pressure exerted on contact point 58 by guide member 5 is adjusted by captured adjustment screws 56 in partially threaded holes 57.

Rotational movement 62 in this example has two components, a forward and back movement 60 and an up and down movement 61. Guide member 5 constrains the amount of up and down movement 61 to the location of contact point 58 and rate of curve for curved inner surface 59. A relatively flat curved inner surface 59 or a forward location for contact point 58 results in a smaller up and down movement 61. In contrast, a relatively curved curved inner surface 59 or a backward location for contact point 58 results in a larger up and down movement 61. The major movement, forward and back movement 60, is influenced by the frictional pressure exerted at contact point 58 by guide member 5 on reciprocating support 4. High pressure decreases movement and low pressure increases movement.

Figure 10B:
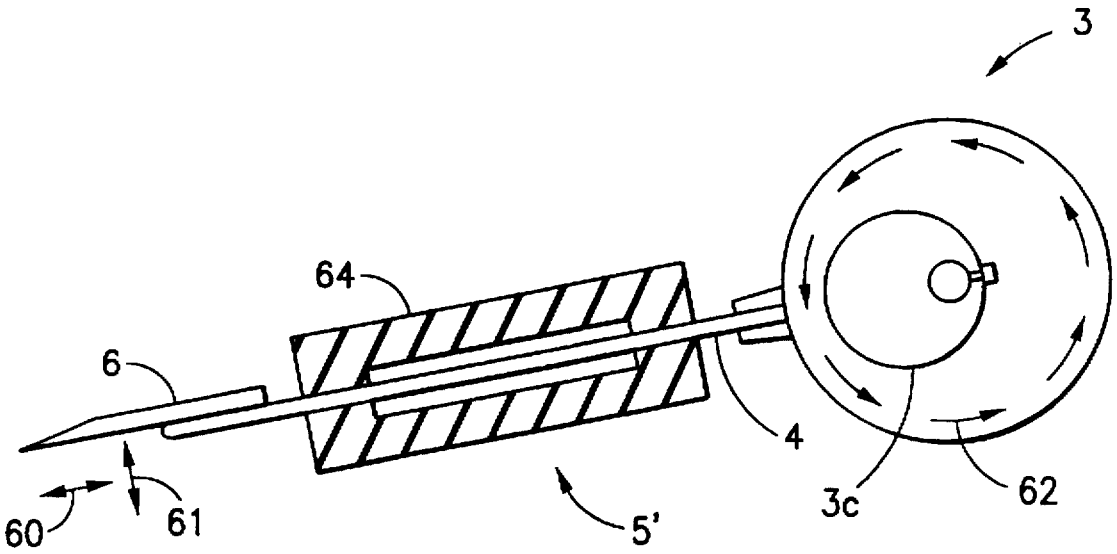
FIG. 10*b* is an illustrative cross section of a second example of guide member function effecting the motion of a reciprocating support.
Figure 11B:
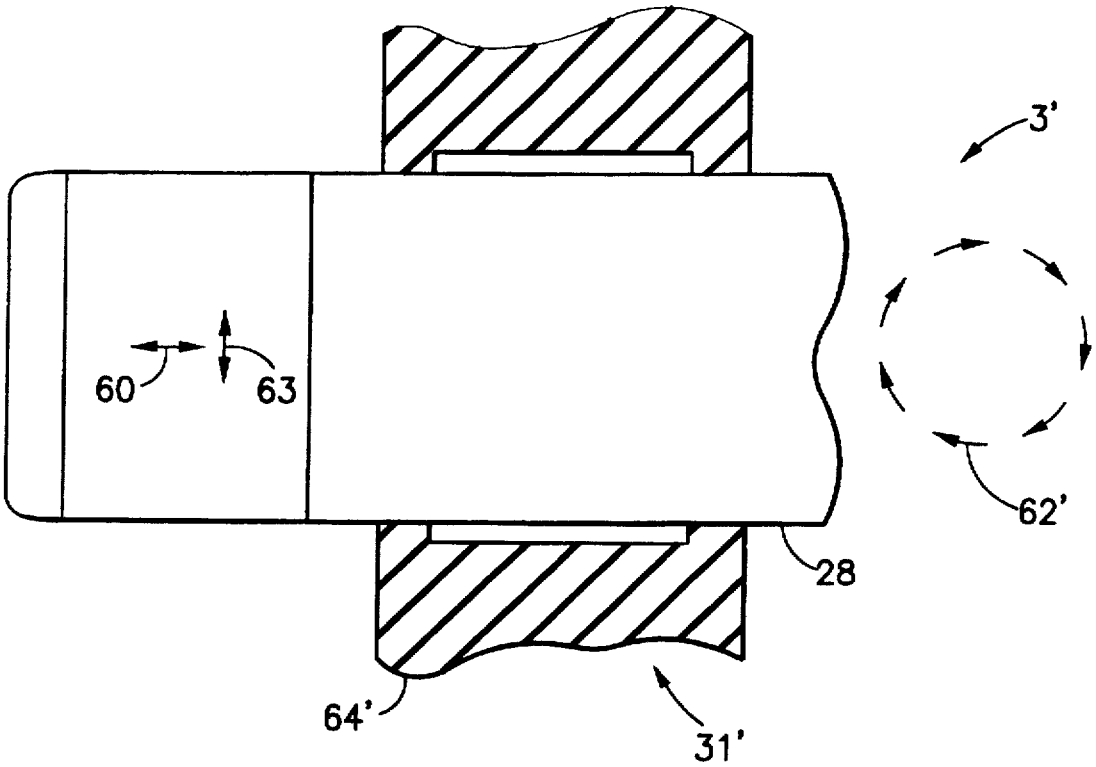
FIG. 11*b* is an illustrative cross section of a fourth example of guide member function effecting the motion of a reciprocating support.

The mechanism of adjustment in not important and many other mechanisms are possible. FIG. 10b as another example adjusts the relative amounts of movements 60 and 61 by simple material constraints. Guide 5, in this example, is made of facing rubber C channels 64. Reciprocating support 4 slides between the channels allowing forward and back movement 60 to be relatively large. A small amount of give in the rubber allows up and down movement 61 to be small. The density and thickness of the rubber also influences these motions.

Figure 11A:
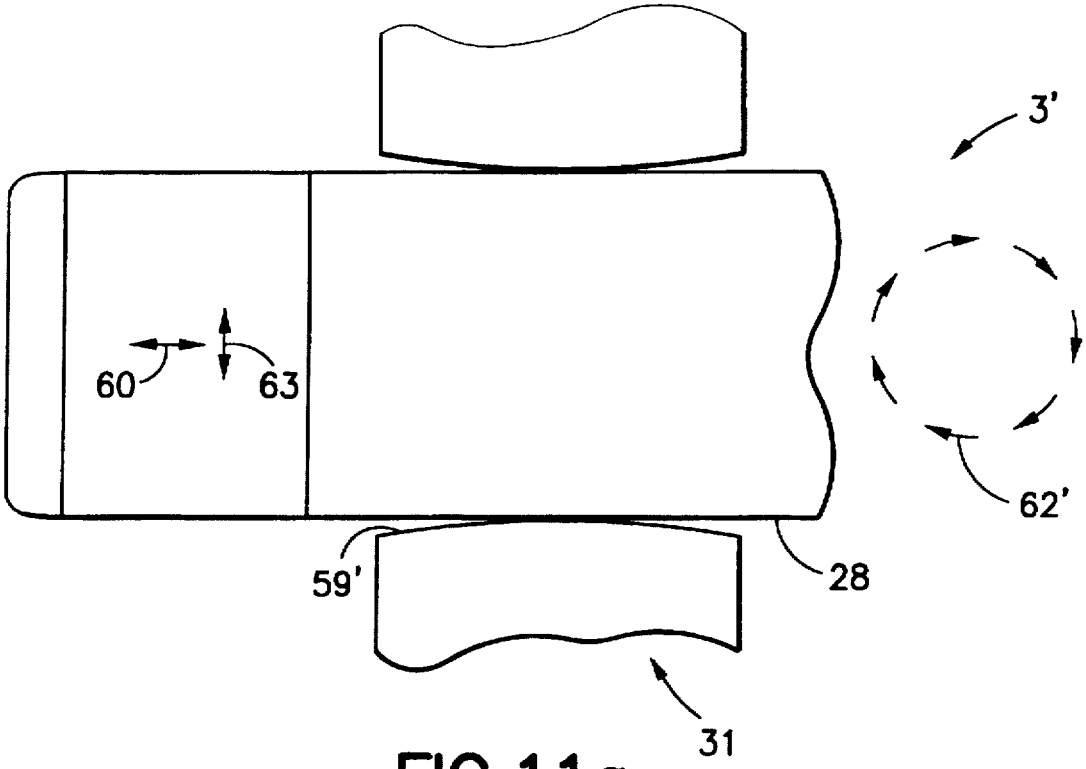
FIG. 11*a* is an illustrative cross section of a third example of guide member function effecting the motion of a reciprocating support.

Referring to FIGS. 11a and b in the context of FIGS. 10, rotational movement 62 turned ninety degrees on the sagittal axis becomes a rotational movement 62'. This replaces the minor component, up and down movement 61, of the first examples, with a side to side movement 63.

Figure 12A:
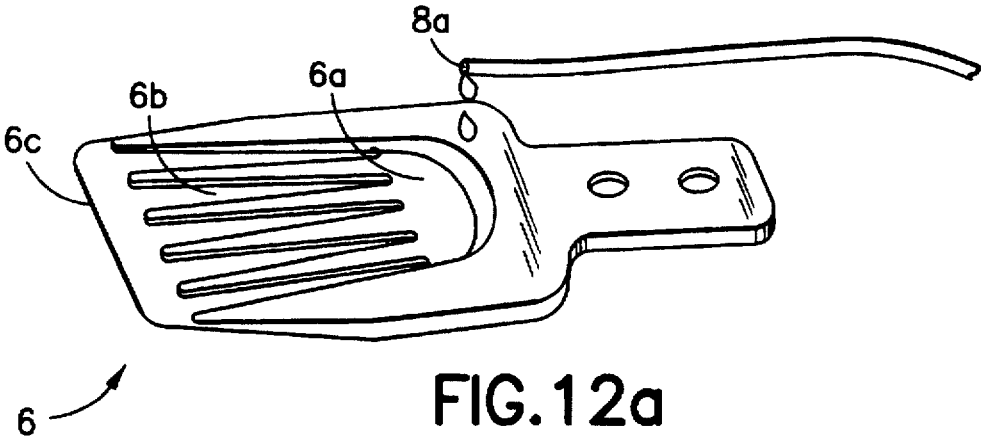
FIG. 12*a* is a perspective view of a first example of a scraper positioned relative to a liquid dispensing outlet.
Figure 12B:
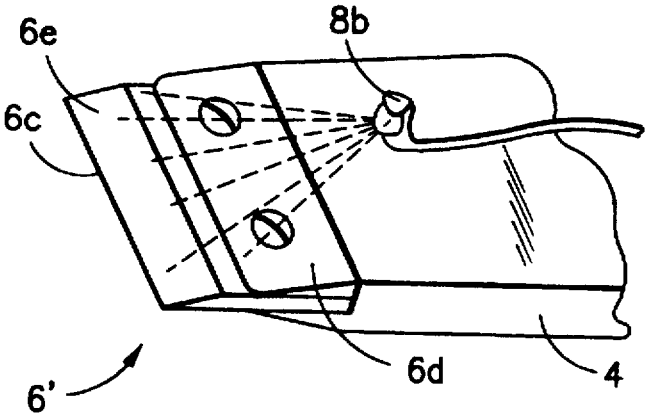
FIG. 12*b* is a perspective view of a second example of a scraper attached to a reciprocating support positioned relative to a liquid spray outlet.
Figure 12C:
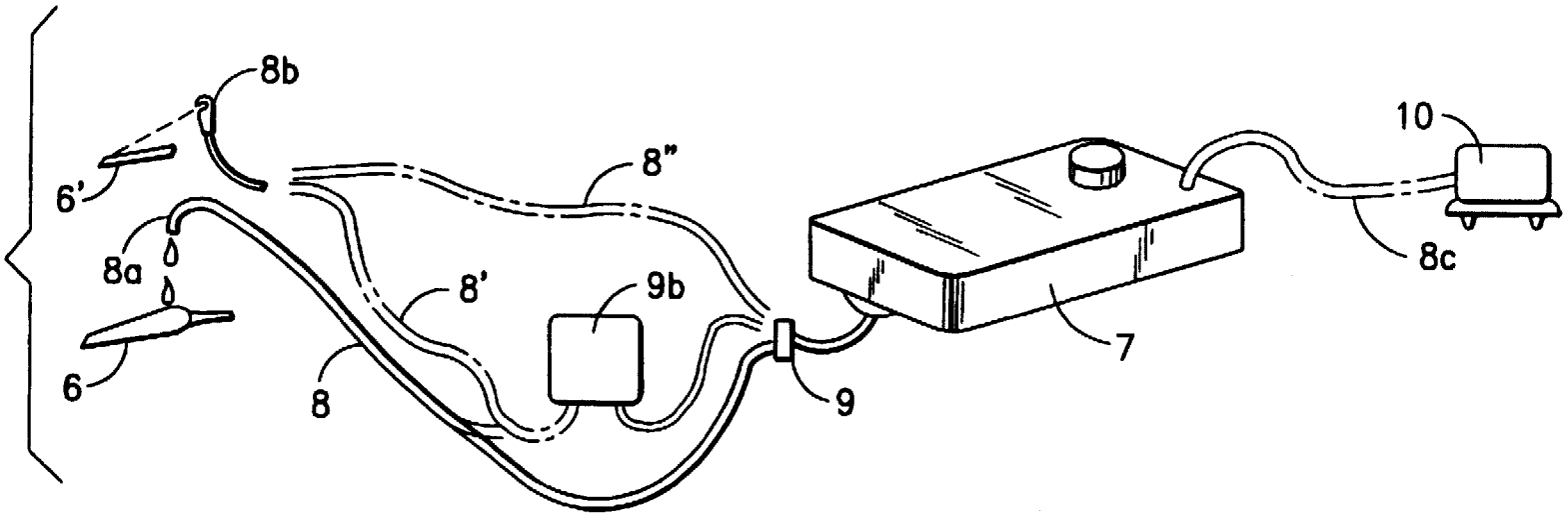
FIG. 12*c* is a composite illustration of the components of several liquid handling systems for the present invention.

Referring to FIGS. 12a, 12b, and 12c in the context of FIGS. 1 and 2, reciprocating scraper blade 6 has a hollow 6a, to retain liquid. A plurality of grooves 6b run from hollow 6a toward a knife edge 6c. Alternatively, a clamp 6d holds a disposable scraper blade 6e to reciprocating support 4.

A tank 7, for holding a cleaning solution, such as soap and water, or a solvent, is mounted in the middle of boat shaped casing 2. A length of tubing 8 extends from tank 7 to a location above reciprocating scraper blade 6 to feed cleaning solution into hollow 6a. Valve 9 in tubing 8 is located near tank 7. Alternatively, valve 9 is connected directly to tank 7 forming the connection between tank 7 and tubing 8. Valve 9 is operated by a valve lever 23 to control the flow of cleaning fluid through tubing 8. When valve lever 23 is pressed, a traction wire 24, connected to valve lever 23, opens valve 9 to pour cleaning solution from tank 7 through a liquid outlet 8a into hollow 6a of reciprocating scraper blade 6.

An alternative system, shown with single dashed lines, includes a liquid pump 9b in a tubing 8' that feeds liquid under low pressure to liquid outlet 8a, or under high pressure to liquid nozzle 8b. Liquid emerging from liquid nozzle 8b is sprayed onto knife edge 6c of a scraper blade 6'.

In another alternative system, shown with double dashed lines, tank 7 is pressurized with air from air pump 9c through pressure tubing 8c. When valve 9 is opened liquid is forced out of tank 7 through a tubing 8" and is sprayed from liquid nozzle 8b onto scraper 6'. Air pump 9c may be powered by the same motor that powers reciprocating driver 3 or may be powered by a separate dedicated motor.

Figure 13:
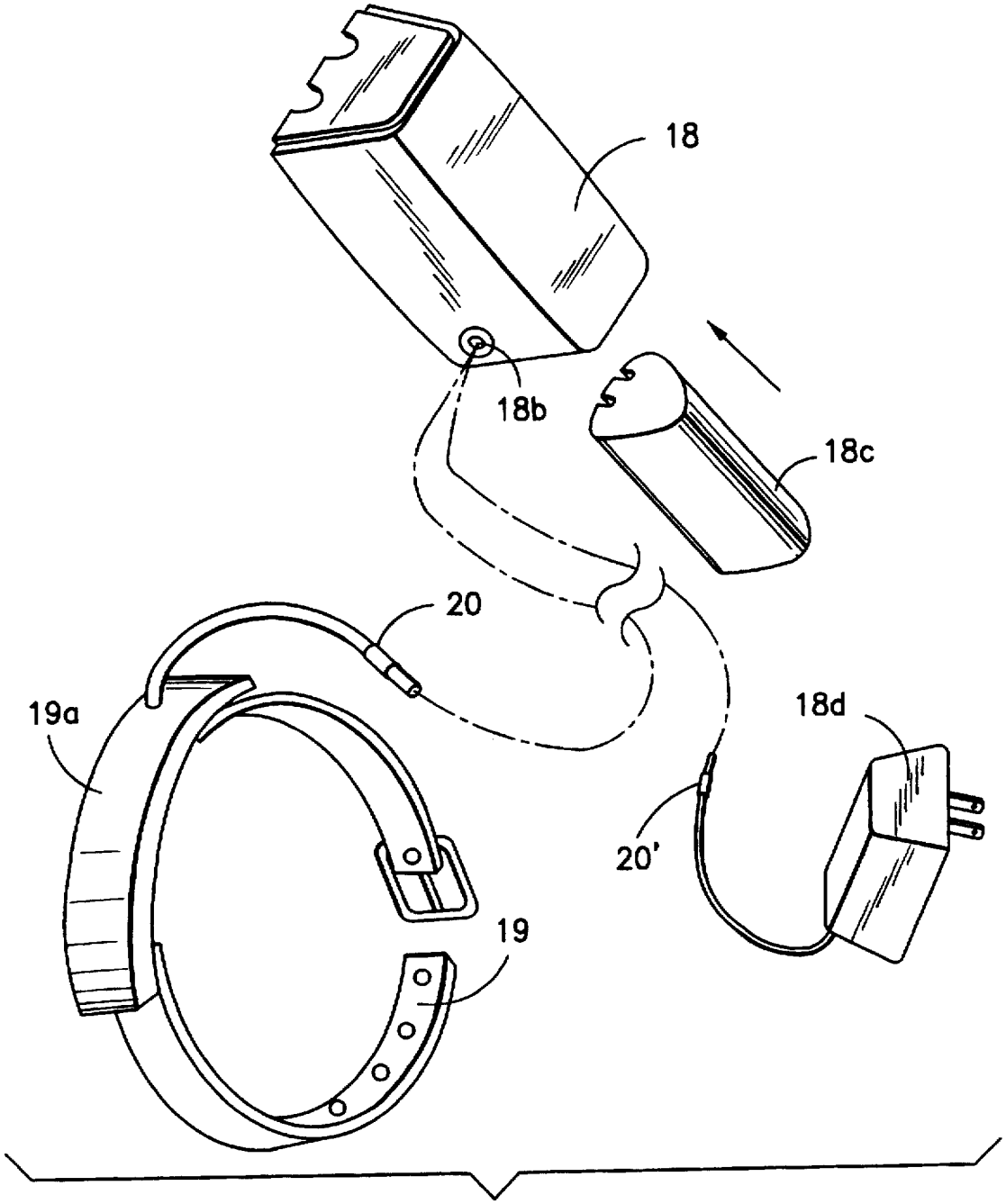
FIG. 13 is a composite illustration of the components of a battery power supply for the present invention.

Electricity to power the motors of the present invention may be supplied externally via an electrical cable or internally by batteries. Referring to FIG. 13 in the context of FIG. 1, front portion 18a of a battery pack housing 18 is snap-fitted to a rear opening of vacuum cleaner system 11. Power is suppliable to suction device 10 and reciprocating driver 3 by batteries (not shown) inside battery pack housing 18. Prolonged operation is made possible by extra batteries 19a mounted on a belt 19 of a user. A plug 20 insertable into external power receptacle 18b on battery pack housing 18 supplies power from extra batteries 19a to chewing gum remover 100. Alternatively, rechargeable battery packs 18c may be replaced periodically in battery pack housing 18. Rechargeable battery pack 18 may be recharged externally or by connection of a recharging transformer 18d through a plug 20' to external power receptacle 18b. Recharging transformer 18*d* may also be used as a secondary source of power to supplement the batteries.

Referring now specifically to FIG. 1, when collection chamber 13*b* and suction nozzle 13*a* pivot forward through a predetermined angle about studs 15 toward boat shaped casing 2, the bottom of collection chamber 13*b* presses limit switch 17. Closure of limit switch 17 activates reciprocating driver 3 and suction device 10. When nozzle lever 22 pulls suction nozzle 13 and collection chamber 13*b* away from boat shaped casing 2, limit switch 17 opens, thereby deactivating reciprocating driver 3 and suction device 10. Independently, power switch 21, attached to one end of hollow shaft 1 near handle 1*a*, activates suction device 10 and reciprocating support 4.

Figure 14:
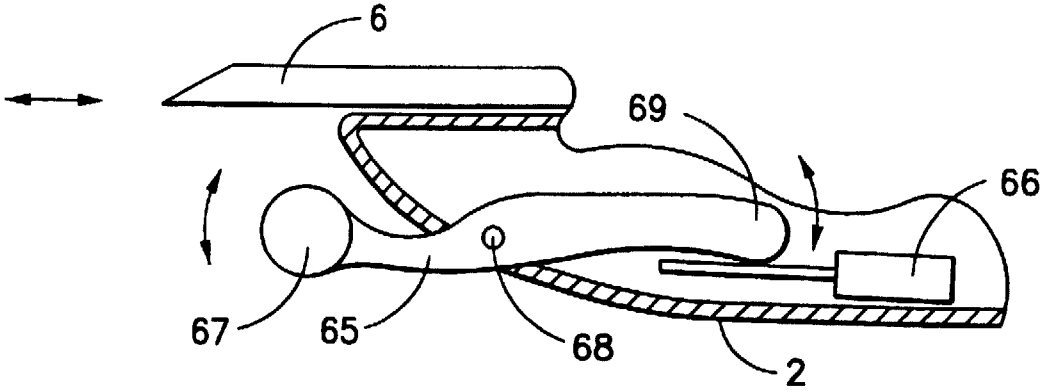
FIG. 14 is a longitudinal cross section of the front portion of an embodiment of the present invention showing the placement of a safety switch.

Optionally, referring now to FIG. 14, a lever 65 extends from boat shaped casing 2 immediately beneath reciprocating scraper blade 6. Lever 65 has a rider bar 67 externally and a lever arm internally of boat shaped casing 2. When rider bar 67 is pressed upward toward boat shaped casing 2 externally lever 65 pivots around a pivot point 68 causing a lever arm 69 to swing downward toward boat shaped casing 2 internally. Downward swinging of lever arm 69 causes a switch 66, mounted internally on boat shaped casing 2, to close thereby turning on reciprocating driver 3 and/or suction device 10. When chewing gum remover 100 is positioned on the surface where work is to occur switch 66 is closed and chewing gum remover 100 begins to operate. Lifting chewing gum remover 100 from the surface automatically ceases operation.

Chewing gum is separated from the floor by the combined effect of cleaning solution and reciprocation of reciprocating scraper blade 6. Suction device 10 sucks the loosened chewing gum into a collection chamber 13*b*. Sponge 32 attached to boat shaped casing 2 may be used for wiping the floor.

Figure 15:
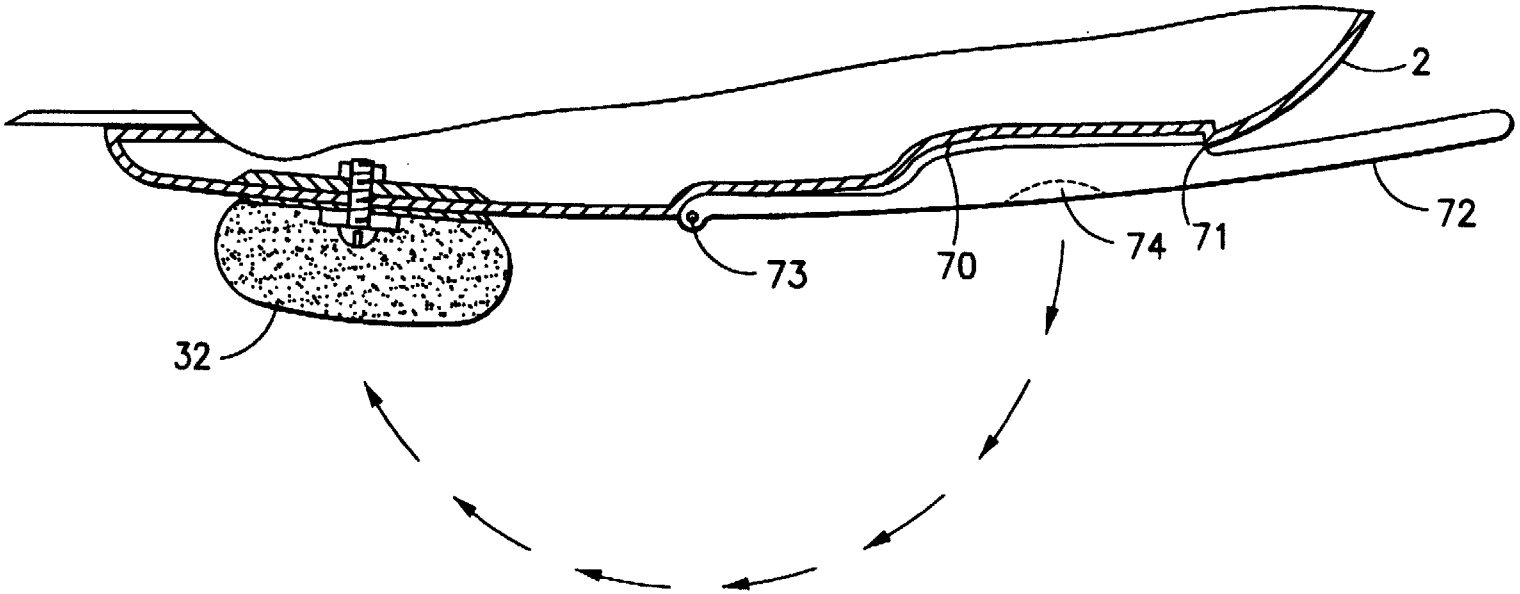
FIG. 15 is a longitudinal cross section of the bottom of the present invention showing the placement and mechanism of an optional sponge and wringer.

Referring now to FIG. 15 in the context of FIG. 1, sponge 32 is attached to the bottom of boat shaped casing 2. Optionally, a wringer 74, attached within a storage impression 70 of boat shaped casing 2, is used to squeeze excess liquid from sponge 32. To operate wringer 74, a worker pulls a handle 72 to release wringer 74 from a friction latch 71, and swings it around a hinge 73 to contact sponge 32.

The present invention easily removes chewing gum adhering to a surface, such as a floor. Removal of chewing gum is rapid and sanitary due to the combined effect of cleaning solution fed from tank 7 and the reciprocation of reciprocating scraper blade 6. Remaining dirt may be cleaned by soapy water and sponge 32. Collection chamber 13*b* holds collected pieces of chewing gum securely. Gum will not spill from collection chamber 13*b* even when suction nozzle 13*a* and collection chamber 13*b* pivot during operation of nozzle lever 22.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A gum removal machine, comprising:

a frame;

a scraper extending from said frame;

means in said frame for reciprocating said scraper with respect to said frame;

said scraper having an outer end shaped for removal of adhered material from a surface;

a container;

means for moving pieces of material loosened by said scraper into said container;

said means for moving mounted on said frame;

a tank, mounted on said frame; and means for discharging a liquid from said tank to said outer end, whereby loosening of said adhered material is facilitated.

2. The device of claim 1, wherein said means for discharging includes:

a valve controlling a flow of liquid from said tank;

means in said scraper for receiving said liquid from said valve, and delivering said liquid to said outer end.

3. A gum removal machine, comprising:

a frame;

a scraper extending from said frame;

means in said frame for reciprocating said scraper with respect to said frame;

said scraper having an outer end shaped for removal of adhered material from a surface;

a container;

means for moving pieces of material loosened by said scraper into said container;

said means for moving pieces of material loosened including a nozzle attachable to said frame;

said nozzle having a forward opening;

means for sucking air through said forward opening and into said container;

said container being positioned between said nozzle and said means for sucking;

said nozzle having a rear opening;

said container being connected to said rear opening;

a tank; and means for discharging a liquid from said tank to a location near an end of said scraper.

4. A device for removing adhered material from surfaces, comprising:

a frame;

a reciprocating scraper having a knife edge;

said reciprocating scraper mounted on said frame;

vacuum cleaner means oriented for drawing a suction air flow over said knife edge, said vacuum cleaner means mounted on said frame; and means for delivering a liquid to said knife edge, said means for delivering being mounted on said frame.

5. The device of claim 4 wherein said reciprocating scraper further includes:

a reciprocator;

at least one mount;

a reciprocating blade support attached to said reciprocator;

said reciprocating blade support movably connected to said frame by said at least one mount; and said reciprocating blade support attached to said scraper.

6. The device of claim 5 wherein said reciprocator includes:

a motor having a motor shaft;

said motor shaft having a first axis;

a second shaft having said first axis;

said second shaft supported by a bearing;

a coupler having an eccentric weight; and said coupler coupling said second shaft in axial alignment with said motor shaft.

7. The device of claim 5 wherein said reciprocator includes:

a circular member having a first axis;

said circular member has at least one shaft having a second axis;

said second axis being eccentric to said first axis;

means for rotating said circular member about said first axis; and means for rotatably coupling said scraper to said at least one shaft.

8. The device of claim 5 wherein said reciprocator includes:

a motorized cam having a lobed surface;

an end of said reciprocating blade support;

said end contacting said lobed surface; and means for maintaining contact of said end with said lobed surface when said cam is rotating.

9. The device of claim 5 wherein said vacuum cleaner means includes:

a hollow nozzle mounted on said frame;

a chamber attached to said hollow nozzle;

means for drawing air through said nozzle then through said chamber; and means for filtering particles from air passing through said chamber.

10. The device of claim 5 wherein said means for delivering a liquid to said knife edge includes:

a tank having an inlet and an outlet;

a valve flowably connected to said outlet;

a liquid pump flowably connected to said valve;

a tubing having a first end flowably connected to said pump; and a second end of said tubing directed toward said knife edge.

11. The device of claim 10 further including a liquid spray nozzle connected to said second end of said tubing.

12. The device of claim 5 wherein said mount includes a flexible compressible rubber piece contacting said reciprocating blade support.

13. The device of claim 5 wherein said mount is channel shaped to allow said reciprocating blade support to slidably move forward and back, and to allow said reciprocating blade support to rock one of vertically and laterally.

* * * * *